US005749277A

United States Patent [19]

Walker

[11] Patent Number: 5,749,277

[45] Date of Patent: May 12, 1998

[54] CUTTING MECHANISM FOR RECEIPT PRINTER

[75] Inventor: Alan H. Walker, Barton, N.Y.

[73] Assignee: Axiohm IPB Inc, Ithaca, N.Y.

[21] Appl. No.: 652,744

[22] Filed: May 23, 1996

[51] Int. Cl.[6] ..... B26D 1/06

[52] U.S. Cl. ..... 83/563; 83/566; 83/568; 83/624

[58] Field of Search ..... 83/73, 209, 628, 83/695, 697, 563, 566, 568, 584, 613, 222, 279

[56] References Cited

U.S. PATENT DOCUMENTS

| | | | |
|---|---|---|---|
| 4,732,068 | 3/1988 | Yasuda et al. | 83/695 |
| 5,000,070 | 3/1991 | Ozawa et al. | 83/628 |
| 5,153,661 | 10/1992 | Shimizu et al. | 83/209 |
| 5,408,908 | 4/1995 | Rosenthal et al. | 83/584 |
| 5,438,246 | 8/1995 | Baeuerle et al. | 83/628 |

*Primary Examiner*—Maurina T. Rachuba
*Attorney, Agent, or Firm*—Salzman & Levy

[57] ABSTRACT

The present invention features a cutting mechanism for a receipt-printing machine, which has paper dispensed from a paper-supply roll. The cutting mechanism has a "v"-shaped, guillotine blade that is held in a blade holder. The blade is driven via the blade holder against a stationary blade and into cutting contact with a paper web containing receipt indicia. The paper web is dispensed from a paper-supply roll located within the printer. A displaceable cover is provided to allow for convenient paper loading and, occasionally, paper jam clearing. There is a blade guide which has side mountings for guiding at least one end tab of the guillotine blade into perpendicular contact with the paper web. The guillotine blade is driven through the blade guide into cutting contact with the paper by a drive cam. The drive cam rotatively engages the blade holder, providing the blade with a forward thrust. The cam is driven by a motor-driven gear train that has a timing gear. The rotating timing gear activates a switch after every complete rotation, which terminates power to the motor, thus allowing a single rotation for the drive cam and, hence, a single cutting cycle. The guillotine retracts from the blade guide under the influence of spring biasing, and is then ready for the next cutting cycle. The guillotine blade is retracted to a remote position within the printer.

26 Claims, 3 Drawing Sheets

CUTTING MECHANISM FOR RECEIPT PRINTER

RELATED APPLICATION

The present application is related to U.S. patent application Ser. No. 08/325,441, for "Openable Thermal Printer," now U.S. Pat. No. 5,579,043, and hereby incorporates by reference the entirety thereof.

FIELD OF THE INVENTION

The invention pertains to cutting blade mechanisms for cutting strips of paper from paper rolls housed in receipt-printing apparatuses and, more particularly, to a cam-actuated, guillotine-blade apparatus for cutting a measured strip of an advancing paper web that is dispensed from a floating paper roll disposed within a bucket of a thermal receipt-printing device.

BACKGROUND OF THE INVENTION

Retail establishments such as: supermarkets; financial institutions, including automatic teller machines; and business offices, including, for example, fax machines, require machinery for printing receipts of transactions. The Axiohm corporation, located in Ithaca, N.Y., manufactures such machinery (e.g., its Model Nos. 7156 and 7193), which prints a receipt, quickly dispensing the slip through a slot in the top of the printer housing.

In the past, printers were cumbersome, slow and unreliable. Even the paper-loading process itself was difficult and wearisome, viz., requiring that the paper roll be placed upon a mandrel, and then carefully threading the paper web through a series of driving rolls. The paper loading procedure required that the check-out clerk (or supervisor) had to receive training in the ways of loading the paper. Reloading the paper rolls was always fraught with problems. It was not uncommon to have paper jams, misthreaded drives and long delays at check-out counters.

Axiohm receipt printers have been designed for convenient paper-loading, thus eliminating the heretofore requisite training and downtime needed for roll replacement. The paper supply roll of the Axiohm printers is not rigidly guided and, therefore, needs no threading. The paper-loading procedure is simple. The paper-supply roll is dropped into a well or bucket that is accessed upon opening the lid to the printer housing. The end of the paper web is placed in a dispensing slot, and the lid of the printer then closed.

The present invention provides a cost-effective, reliable cutting mechanism using a movable guillotine-stationary blade combination in the formation of the receipt through severing the paper web. Conventional rotary cutting blades pivot out of the housing, when the lid is opened to reload a paper-supply roll, but it has been found that the reliability of a guillotine blade can be incorporated in such a housing.

The invention also improves existing technology by utilizing a spring-loaded, guillotine blade. The paper is quickly chopped by the guillotine blade, which employs a perpendicular thrust. The blade is made safe by a cam-driven, single-cutting cycle. The blade is spring-biased; it retracts into the printer housing after every cutting cycle.

SUMMARY OF THE INVENTION

In accordance with the present invention, there is provided a cutting mechanism for a receipt-printing machine having paper dispensed from a floating, paper-supply roll. The cutting mechanism comprises a movable "v"-shaped, guillotine blade that is held in a blade holder, and a stationary blade having a bowed profile for providing a shear angle when the movable blade is caused to move against it. The movable blade is driven via the blade holder into cutting contact with a paper web containing receipt indicia. The paper web is dispensed from a floating, paper-supply roll disposed within a bucket of the printer housing. There is a blade guide which has side mountings for guiding the end tabs of the guillotine blade into perpendicular contact with the paper web. The guillotine blade is driven through the blade guide into cutting contact with the paper by means of a bell crank slider arm. The bell crank slider arm rotatively engages the blade holder, providing the blade with a forward thrust. The slider arm is driven by a motor-driven gear train that has a timing gear cam. The rotating timing gear cam activates a switch after every cutting cycle, which terminates power to the motor, thus allowing a single rotation for the slider arm and, hence, a single cutting cycle. The guillotine retracts from the blade guide when motor direction is reversed. For purposes of safety, the guillotine blade is retracted to a remote position within the printer housing under the influence of spring biasing, if the printer cover is opened anytime during the cycle or if opened if power is interrupted. Thus, as long as the housing cover is open, the guillotine blade is retracted.

BRIEF DESCRIPTION OF THE DRAWINGS

A complete understanding of the present invention may be obtained by reference to the accompanying drawings, when considered in conjunction with the subsequent detailed description, in which.

For the sake of clarity, like components will bear the same numerical designations throughout the FIGURES.

DESCRIPTION OF THE PREFERRED EMBODIMENT

Generally speaking, the invention pertains to a cutting mechanism for a printing-machine having a paper-supply roll disposed therein. The paper-supply roll furnishes the paper used to print retail receipts. The cutting mechanism utilizes a guillotine-type knife blade and a stationary blade to cut the paper web, after the receipt indicia has been printed thereupon. The cutting mechanism's guillotine blade is guided into impact with the paper and a stationary blade and, thereafter, safely retracted to a remote position within the machine.

Figure 1:
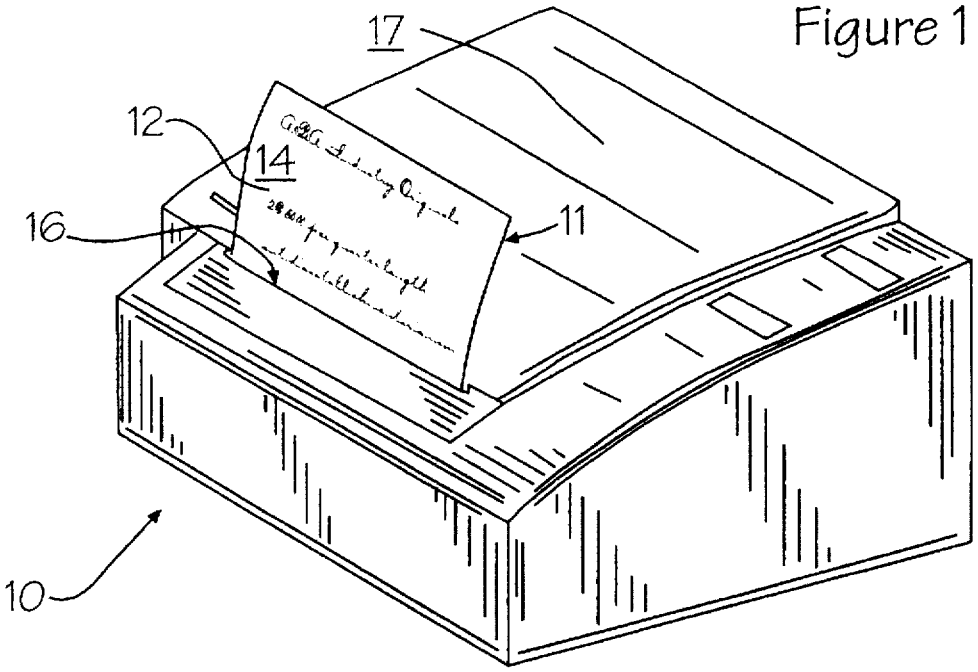
FIG. 1 shows a perspective view of a thermal printer with a typical receipt from a floating roll of supply paper.
Figure 2:
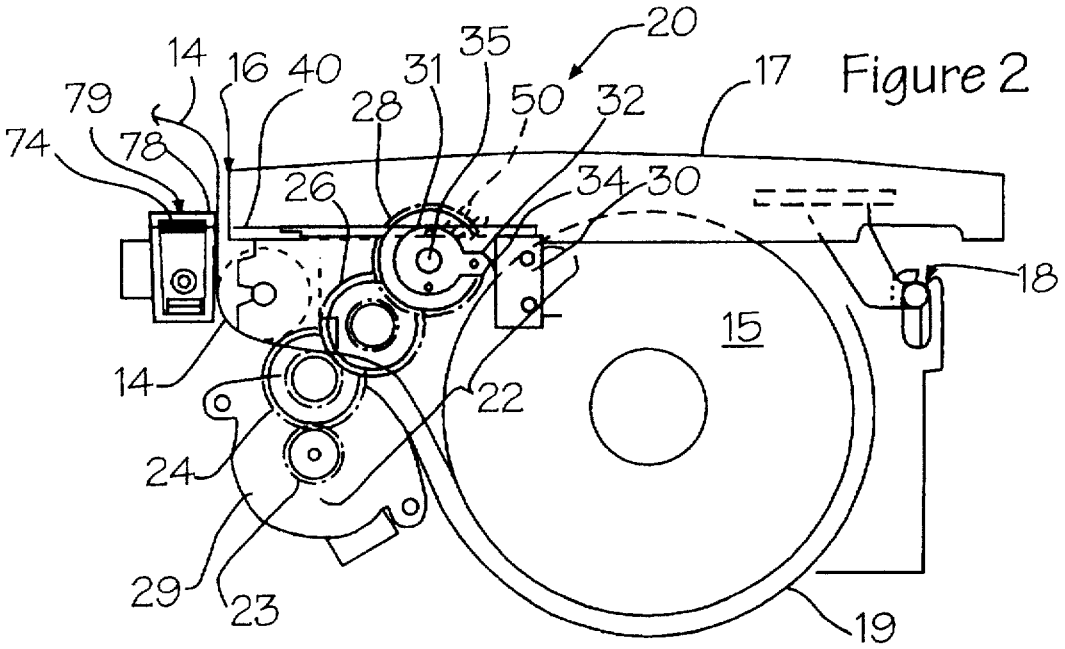
FIG. 2 depicts a side view of the cutting mechanism of this invention, including a printer cover, drive motor, gear train, switch, movable and stationary blades, blade guide, timing gear cam, paper roll and bucket.

Now referring to FIG. 1, a printer 10 for printing a sales receipt 11 is shown. The indicia 12 of the receipt 11 is printed upon a web of paper 14 that is supplied from a supply roll of paper 15 (FIG. 2). The paper web 14 is pushed through the slot 16 in the top of printer 10. A cover 17 forms part of the slot opening, as illustrated. A stationary knife blade, not shown, receives a movable cutting blade 40 between which blades the paper web 14 passes, as is further explained hereinafter.

Figure 5:
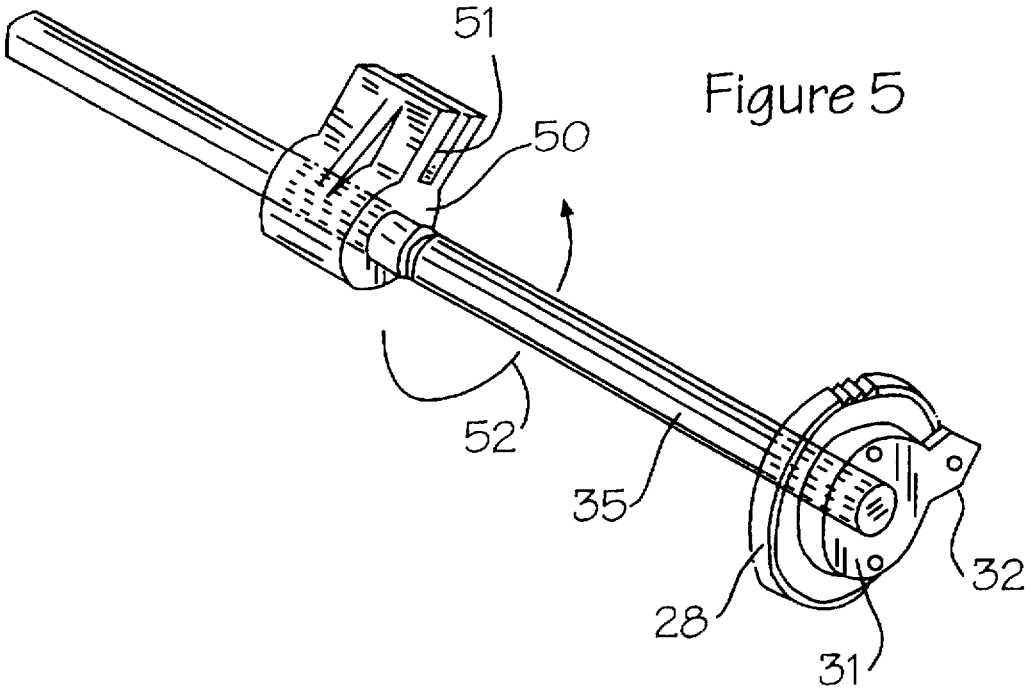
FIG. 5 shows an enlarged, perspective view of the camshaft drive assembly for the cutting mechanism depicted in FIG. 3.

Referring to FIG. 2, a partial, side view of the preferred embodiment cutting mechanism 20 of this invention is depicted. As aforementioned, the cover 17 forms part of the dispensing slot 16 in the top of the printer 10, from which the paper web 14 is discharged. Two hinges 18 allow the cover 17 to pivotably open, in order to expose the bucket 19 that supports the paper supply roll 15. A gear train drive 22, consisting of intermediate gears 24 and 26; end gear 28; and pinion drive gear 23; is illustrated in phantom, and is powered by motor 29. The end gear 28 is a timing gear that carries a cam 31 having a projecting finger 32, which can be better observed in FIGS. 3 and 5.

The cam finger 32 is operative by depressing the switching button 34 of momentary switch 30. The end gear 28 is rotatively carried by the cover 17 via shaft 35, which is rotatively affixed therein. When the cover 17 is in the closed position, the end gear 28 comes into rotative contact with intermediate gear 26, thus completing the drive gear train 22. In depressing button 34 of switch 30, the cam finger 32 interrupts the power to motor 29. When the finger 32 returns to its home position, a full turn of end gear 28 provides one cutting cycle for the movable blade 40. The motor 29 will be actuated at the end of the receipt print-cycle, so that the gear train 22 will be rotatively powered, causing a receipt to be cut from the web 14, as is explained in more detail hereinafter.

Figure 3:
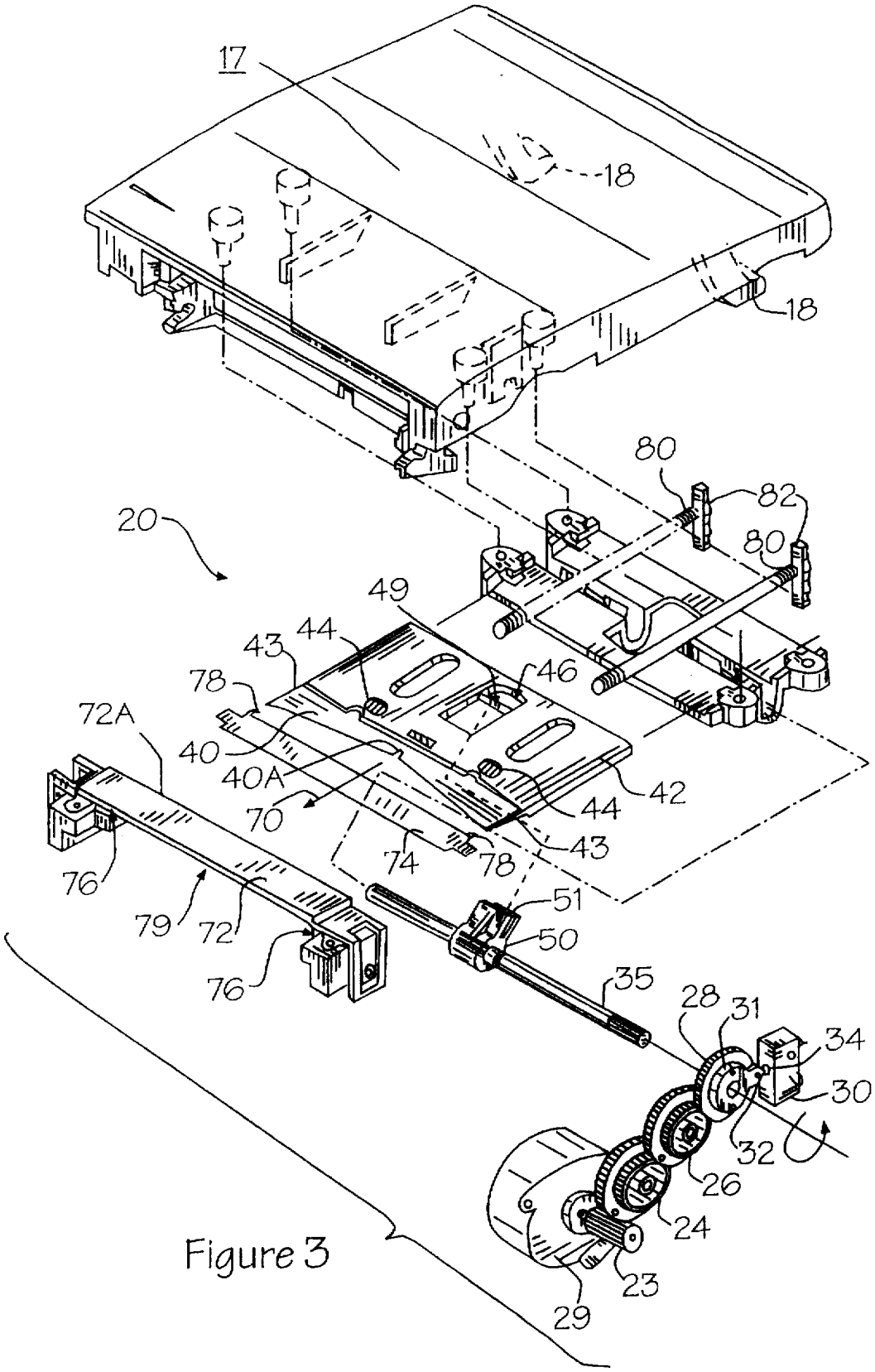
FIG. 3 shows a perspective, exploded view of the cutting mechanism of the invention illustrated in FIG. 2.

Referring now to FIG. 3, the total assembly of the cutting mechanism 20 of this invention is shown in exploded view. A "v"-shaped, movable guillotine blade 40 is depicted in a holder 42. The center of blade 40 is provided with a notch or cutout 40*a*, so that paper 14 need not be completely severed at the center axis thereof, for the convenience of the operator.

The blade 40 is attached to the holder 42 via a pair of tab units 44. The holder 42 comprises slotted end guides 43 for supporting blade 40 in registration therewith. The registration is required for providing a perpendicular cut with respect to the paper web 14. In operative relationship to the movable knife assembly 40, 42 is a tensioned, convexly-bowed stationary blade 72*a* described in greater detail hereinbelow.

Figure 4:
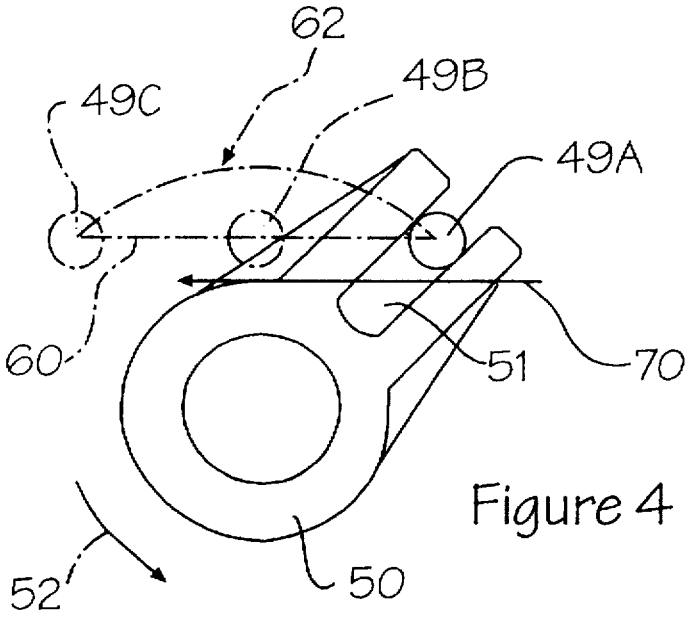
FIG. 4 illustrates an enlarged, side view of the bell crank slider arm and blade pin shown in the cutting mechanism of FIG. 3.

The holder 42 is shown in enlarged, perspective view. The holder 42 has a center aperture 46, across which is disposed a cam pin follower 49. The cam pin follower 49 rests within the slot 51 of cam 50, shown in greater detail in FIGS. 4 and 5. The slotted cam 50, which is affixed to shaft 35, will rotate counterclockwise (arrow 52) when the gear train 22 is operative. The slotted cam 50 will traverse the arcuate path, shown by reference numeral 62 (FIG. 4). The cam pin follower 49, shown in sequential positions 49*a*, 49*b* and 49*c*, resting in slot 51 of cam 50 (FIG. 4), will then be caused to move laterally forward (arrow 70) along cutting axis 60. The traversing of the pin through positions 49*a*, 49*b* and 49*c*, respectively, defines the movement between a retracted blade position, an intermediate position and a cutting blade position. As pin 49 moves forward in a reciprocating fashion, the holder 42 and its captive guillotine blade 40, likewise move forward. The blade 40 then comes into cutting contact with the paper web 14, against stationary blade 72*a*, thus severing the web of paper 14 to form a receipt 11, as previously shown in FIG. 1.

Referring again to FIG. 3, a guide member 72 having a stationary cutting edge 72*a* and a guide plate 74 disposed in slots 76 is illustrated. The guide member 72 and blade 72*a* accommodate the forward movement of the guillotine blade 40 thereagainst (arrow 70). The guide plate 74 has end tabs 78 which project downwardly, as also shown in FIG. 2. These downwardly-facing end tabs 78 act as a guide to blade 40, thus coaxing it into conformity with the slot 79 formed between the guide plate 74 and the bowed guide member 72. One end tab 78 is all that is required if the movable blade 40 is a continuous, angled cutting edge. Guide member 72 and its stationary cutting edge or blade 72*a* is bowed convexly (upwardly in FIG. 3) in order to provide an appropriate surface against which guillotine blade 40 moves to initiate and complete a cutting action.

A pair of springs 80, schematically shown, is affixed to blade holder 42 and housing 82. The springs 80 draw the blade 40 back into the housing 82 when the cover 17 is opened. A lever (not shown) releases the springs 80 when the cover 17 is lifted. Being removed to a remote position, the blade 40 is now safely out of the reach of an operator, who may be reloading the receipt printer with a fresh supply-roll 15 of paper, 14.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. For example, the movable blade camshaft 35 may be driven from the opposite side of the printer housing 82, as that shown, by a suitable gear train driven by the receipt drive motor. A one-way clutch would be required on the receipt driver platen shaft gear, so that the motor can be reversed to drive the knife mechanism, thus eliminating a separate knife motor.

Having thus described the invention, what is desired to be protected by Letters Patent is presented in the subsequently appended claims.

What is claimed is:

1. A cutting mechanism for a receipt printer, comprising:

a printer housing;

means defining a paper-web path disposed in said printer housing;

a movable cutting blade being movable between a retracted position and a cutting position, said movable cutting blade intersecting said paper-web path in order to cut a receipt therefrom;

a supply of paper supported by said printer housing, said supply of paper furnishing a web of paper for traversal along said paper-web path;

drive means connected to said movable cutting blade for moving said movable cutting blade between said retracted position and said cutting position; and a guide member disposed along said paper-web path for receiving said movable cutting blade as it moves toward its cutting position, said guide member having a guide plate with at least one end tab for coaxing said movable cutting blade into conformity with said guide member, said guide member having a stationary cutting edge for receiving said movable cutting blade, to initiate and complete the severing of said paper web, and said stationary cutting edge being tensioned and bowed with respect to said printer housing.

2. The cutting mechanism in accordance with claim 1, wherein said movable cutting blade comprises a guillotine blade.

3. The cutting mechanism in accordance with claim 2, wherein said guillotine blade comprises a "v"-shape.

4. The cutting mechanism in accordance with claim 1, wherein said drive means provides a reciprocal motion to said movable cutting blade, wherein said blade is movable between said cutting position and said retracted position.

5. The cutting mechanism in accordance with claim 1, wherein said drive means comprises a motor, a gear train driven by said motor, and a cam driven by said gear train, said cam being in reciprocating contact with said movable cutting blade, and reciprocally driving said movable cutting blade when said motor causes said gear train to rotate said cam.

6. The cutting mechanism in accordance with claim 5, wherein said gear train comprises an end gear that is rotatively affixed to said cam.

7. The cutting mechanism in accordance with claim 1, further comprising a cover operatively connected to said printer housing and displaceable therefrom.

8. The cutting mechanism in accordance with claim 7, further comprising biasing means disposed between said printer housing and said movable cutting blade for retracting said movable cutting blade when said cover is displaced from said housing.

9. The cutting mechanism in accordance with claim 7, wherein said cover is pivotally connected to said printer housing.

10. A cutting mechanism for a receipt printer, comprising:

a printer housing, said printer housing comprises a base portion and a cover portion having an interior section, said cover portion being movably affixed to said base portion and being nominally disposed during operation in a closed position with respect thereto;

means defining a paper-web path disposed in said printer housing;

a movable cutting blade being movable between a retracted position and a cutting position, said movable cutting blade intersecting said paper-web path in order to cut a receipt therefrom, said movable cutting blade being disposed within said interior section of said printer housing cover portion;

a supply of paper supported by said printer housing, said supply of paper furnishing a web of paper for traversal along said paper-web path;

drive means connected to said movable cutting blade for moving said movable cutting blade between said retracted position and said cutting position; and biasing means disposed between said printer housing and said movable cutting blade for retracting said movable cutting blade back into the interior section of the printer housing cover portion, when said cover is lifted from said housing.

11. The cutting mechanism in accordance with claim 10, wherein said movable cutting blade comprises a guillotine blade.

12. The cutting mechanism in accordance with claim 11, wherein said guillotine blade comprises a "v"-shape.

13. The cutting mechanism in accordance with claim 10, wherein said drive means provides a reciprocal motion to said movable cutting blade, wherein said blade is movable between said cutting position and said retracted position.

14. The cutting mechanism in accordance with claim 10, wherein said drive means comprises a motor, a gear train driven by said motor, and a cam driven by said gear train, said cam being in reciprocating contact with said movable cutting blade, and reciprocally driving said movable cutting blade when said motor causes said gear train to rotate said cam.

15. The cutting mechanism in accordance with claim 14, wherein said gear train comprises an end gear that is rotatively affixed to said cam.

16. The cutting mechanism in accordance with claim 13, wherein said stationary cutting edge is tensioned and bowed with respect to said printer housing.

17. The cutting mechanism in accordance with claim 16, further comprising a stationary cutting blade disposed in said printer housing base portion, said stationary cutting blade cooperating with said movable cutting blade when said cover portion is in said closed position, and said stationary cutting blade being disengaged from said movable cutting blade when said cover portion is moved from said closed position.

18. A cutting mechanism for a receipt printer, comprising:

a printer housing;

means defining a paper-web path disposed in said printer housing;

a paper bucket, for receiving a drop-in loaded supply of paper in the form of a supply-roll that is dropped in and supported in said bucket;

a movable cutting blade being movable between a retracted position and a cutting position, said movable cutting blade intersecting said paper-web path in order to cut a receipt therefrom;

drive means connected to said movable cutting blade for moving said movable cutting blade between said retracted position and said cutting position; and a guide member disposed along said paper-web path for receiving said movable cutting blade as it moves toward its cutting position, said guide member causing said movable cutting blade to make a perpendicular cut with respect to said paper web.

19. The cutting mechanism in accordance with claim 18, wherein said movable cutting blade comprises a guillotine blade.

20. The cutting mechanism in accordance with claim 18, wherein said drive means provides a reciprocal motion to said movable cutting blade, wherein said blade is movable between said cutting position and said retracted position.

21. The cutting mechanism in accordance with claim 18, further comprising a cover operatively connected to said printer housing and displaceable therefrom.

22. The cutting mechanism in accordance with claim 21, further comprising biasing means disposed between said printer and said movable cutting blade for retracting said movable cutting blade when said cover is displaced from said housing.

23. The cutting mechanism in accordance with claim 20, wherein said stationary cutting edge is tensioned and bowed with respect to said printer housing.

24. The cutting mechanism in accordance with claim 18, wherein said printer housing comprises a base portion and a cover portion having an interior section, said cover portion being movably affixed to said base portion nominally during operation in a closed position with respect thereto.

25. The cutting mechanism in accordance with claim 24, wherein said movable cutting blade is disposed within said interior section of said printer housing cover portion.

26. The cutting mechanism in accordance with claim 25, further comprising a stationary cutting blade disposed in said printer housing base portion, said stationary cutting blade cooperating with said movable cutting blade when said cover portion is in said closed position, and said stationary cutting blade being disengaged from said movable cutting blade when said cover portion is moved from said closed position.

* * * * *